US008749329B2

(12) United States Patent
Fasano

(10) Patent No.: US 8,749,329 B2
(45) Date of Patent: Jun. 10, 2014

(54) MAGNETIC CIRCUIT INTERRUPTER WITH CURRENT LIMITING CAPABILITY

(75) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 13/446,888

(22) Filed: Apr. 13, 2012

(65) Prior Publication Data

US 2012/0262255 A1 Oct. 18, 2012

Related U.S. Application Data

(60) Provisional application No. 61/475,517, filed on Apr. 14, 2011.

(51) Int. Cl.
*H01H 75/10* (2006.01)
*H01H 77/06* (2006.01)
*H01H 81/04* (2006.01)

(52) U.S. Cl.
USPC ..... 335/39; 335/59; 335/172

(58) Field of Classification Search
USPC ..... 335/2, 6, 7, 21, 35, 172–174, 28, 38, 335/39, 59, 63, 64
See application file for complete search history.

(56) References Cited

U.S. PATENT DOCUMENTS 3,708,723 A 1/1973 Shand et al.
3,863,042 A 1/1975 Nicol
3,919,674 A * 11/1975 Acampora et al. ..... 335/20
4,013,926 A 3/1977 Lang et al.
4,016,518 A 4/1977 Lang et al.
4,710,739 A 12/1987 Heyne et al.
4,811,153 A 3/1989 Sakatos
4,884,164 A * 11/1989 Dziura et al. ..... 361/97
4,897,625 A 1/1990 Yokoyama et al.
4,922,369 A 5/1990 Sakatos
5,089,797 A 2/1992 Grunert et al.
5,369,542 A * 11/1994 Leone et al. ..... 361/94
5,841,616 A * 11/1998 Crosier ..... 361/102
6,031,438 A 2/2000 Runyan (Continued)

OTHER PUBLICATIONS

Weaver, et al.; "Arc Root Mobility on Piezoelectrically Actuated Contacts in Miniature Circuit Breakers"; IEEE Transactions on Components and Packaging Technologies, vol. 28, No. 4 Dec. 2005; pp. 734-740.

(Continued)

*Primary Examiner* — Bernard Rojas
(74) *Attorney, Agent, or Firm* — St. Onge Steward Johnston & Reens LLC

(57) ABSTRACT

A circuit interrupter has a first contact, a second contact, and a trip arm which moves the second contact between a closed position where the second contact is touching the first contact and an open position in which the second contact is spaced apart from the first contact. A first trip mechanism has a first solenoid, a first overcurrent sensor, and a first arm. A second trip mechanism has a second solenoid, a second overcurrent sensor, and a second arm. The first trip mechanism activates the first arm after a first threshold amount of time which actuates the trip arm when the first overcurrent sensor detects a first threshold level. The second trip mechanism activates the second arm after a second threshold amount of time which actuates the trip arm when the second overcurrent sensor detects a second threshold level, the second threshold level being different than the first.

32 Claims, 5 Drawing Sheets

(56) References Cited

U.S. PATENT DOCUMENTS

| | | | |
|---|---|---|---|
| 6,034,586 | A | 3/2000 | Runyan et al. |
| 7,835,120 | B2 | 11/2010 | Fasano |
| 2003/0034864 | A1 | 2/2003 | Castonguay et al. |
| 2006/0250102 | A1 | 11/2006 | Payne |

OTHER PUBLICATIONS

International Search Report and Written Opinion of the International Searching Authority Application No. PCT/US2012/033760 Completed Jul. 11, 2012; Mailing Date: Jul. 20, 2012 12 pages.

* cited by examiner

MAGNETIC CIRCUIT INTERRUPTER WITH CURRENT LIMITING CAPABILITY

CROSS-REFERENCE TO RELATED APPLICATIONS

The present application claims the benefit under 35 U.S.C. §119(e) of U.S. Provisional Patent Application Ser. No. 61/475,517 filed on Apr. 14, 2011, the content of which is hereby incorporated by reference.

FIELD OF THE INVENTION

The present invention relates generally to the protection of electrical devices, and more specifically, relates to a circuit interrupter having multiple solenoids for interrupting a circuit.

BACKGROUND OF THE INVENTION

A circuit interrupter is an electrical component that can break an electrical circuit, interrupting the current. A basic example of a circuit interrupter is a switch, which generally consists of two electrical contacts in one of two states; either closed meaning the contacts are touching and electricity can flow between them, or open, meaning the contacts are separated. A switch may be directly manipulated by a human as a control signal to a system, such as a computer keyboard button, or to control power flow in a circuit, such as a light switch.

A second example of a circuit interrupter is a circuit breaker. A circuit breaker is used in an electrical panel that monitors and controls the amount of amperes (amps) being sent through the electrical wiring. A circuit breaker is designed to protect an electrical circuit from damage caused by an overload or a short circuit. If a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a line and a load. Generally, the line is the incoming electricity, most often from a power company. This can sometimes be referred to as the input into the circuit breaker. The load, sometimes referred to as the output, feeds out of the circuit breaker and connects to the electrical components being fed from the circuit breaker. There may be an individual component connected directly to a circuit breaker, for example only an air conditioner, or a circuit breaker may be connected to multiple components through a power wire which terminates at electrical outlets.

A circuit breaker can be used as a replacement for a fuse. Unlike a fuse, which operates once and then has to be replaced, a circuit breaker can be reset (either manually or automatically) to resume normal operation. Fuses perform much the same duty as circuit breakers, however, circuit breakers are safer to use than fuses and easier to fix. If a fuse blows, oftentimes a person will not know which fuse controls which specific power areas. The person will have to examine the fuses to determine which fuse appears to be burned or spent. The fuse will then have to be removed from the fuse box and a new fuse will have to be installed.

Circuit breakers are much easier to fix than fuses. When the power to an area shuts down, the person can look in the electrical panel and see which breaker has tripped to the "off" position. The breaker can then be flipped to the "on" position and power will resume again. In general, a circuit breaker has two contacts located inside of a housing. The first contact is stationary, and may be connected to either the line or the load. The second contact is movable with respect to the first contact, such that when the circuit breaker is in the "off", or tripped position, a gap exists between the first and second contact.

To trip, or break, a circuit, a solenoid with an overcurrent sensor may be used. When the overcurrent sensor senses a specific current level, or a percentage above the rated current, the solenoid may be actuated to mechanically move an arm tripping the circuit breaker from the closed to the open position.

There have been many proposed devices to mechanically trip a circuit breaker. U.S. Pat. No. 3,863,042 to Nicol discloses a circuit breaker having a handle stop for restraining the handle in a tripped or central position after the circuit breaker has been electrically tripped. The circuit breaker has a movable arm controlled by a toggle mechanism having its knee displaced by the arm of an armature of a coil. The disadvantage of this device is that it is only capable of immediately tripping the circuit breaker at a single current level. This is disadvantageous as the circuit breaker will accidentally trip on the detection of a low current spike, such as the starting of a motor. This renders the circuit breaker almost useless as the circuit breaker will be constantly tripping when the circuit breaker does not need to be tripped.

U.S. Pat. No. 5,089,797 to Grunert et al. proposes a circuit breaker with a single electromagnetically actuated plunger that may be actuated at two levels of excessive current or voltage defined by two air gaps, one at a lower level for triggering a toggle mechanism, the other at a higher level for directly actuating a movable arm through a kicker arm. The introduction of two current level allows the circuit breaker to prime the mechanism that trips the circuit breaker, and then trip the circuit breaker once the current reaches a certain level. As with Nicol above, a disadvantage of this circuit breaker is that it uses a single overcurrent coil to trip the circuit breaker and immediately trips after the detection of the second current level.

To prevent the circuit breaker from accidentally tripping, the tripping mechanism would have to be set to a high level, so that a small current spike would not result in the tripping of the circuit breaker. This, however, would not trip the circuit breaker in the event of a small current spike for an extended period of time, which can damage equipment connected to the circuit breaker.

Instead of setting the tripping mechanism at a high current level, many circuit breakers introduce a delay in the tripping mechanism so that the circuit breaker only trips after the detection of a current spike for a specific period of time. This prevents the circuit breaker from immediately tripping, thus preventing many situations where the circuit breaker would be accidentally tripped upon the detection of a low current spike, but would also protect the equipment from a low current spike that lasts for an extended period of time. The introduction of a delay, however, introduces a problem that can be very dangerous and can severely damage equipment. The introduction of a delay prevents the circuit breaker from immediately tripping when a high current spike, or a short, occurs. For example, if a person accidentally comes into contact with a live wire or live outlet, a large current spike may occur. Any delay in the tripping of the circuit breaker corresponds to an increase in the amount of time the person is in contact with the live wire or outlet. This can lead to severe injury, or even death. A short may also occur if there is a problem with the equipment connected to the circuit breaker, if the circuit breaker waits for a specific period of time to pass before tripping, the equipment connected to the circuit breaker may be severely damaged.

What is desired, therefore, is a circuit interrupter that can automatically trip the circuit at differing voltage or current levels and based on different durations of the voltage or current levels.

SUMMARY OF THE INVENTION

The invention is directed to a circuit breaker capable of tripping at different current levels and after different periods of time. The circuit breaker uses two trip mechanisms to either quickly trip the circuit breaker after the detection of a high current spike, or wait to trip the circuit breaker after a low current spike is present for a certain period of time These and other objects of the present invention are achieved by provision of a circuit interrupter having a first contact and a second contact moveable with respect to the first contact. A trip arm moves the second contact between a closed position in which the second contact is touching the first contact and a current is allowed to flow through the contacts and an open position in which the second contact is spaced apart from the first contact so that the flow of the current is interrupted. A first trip mechanism through which the current flows when the second contact is in the closed position has a first solenoid, a first overcurrent sensor, and a first arm. A second trip mechanism, through which the current flows when the second contact is in the closed position, has a second contact, a second overcurrent sensor, and a second arm. The first trip mechanism activates the first arm after a first threshold amount of time which actuates the trip arm when the first overcurrent sensor detects a first threshold level. The second trip mechanism activates the second arm after a second threshold amount of time which actuates the trip arm when said second overcurrent sensor detects a second threshold level, the second threshold level being different than the first threshold level.

In some of these embodiments, the first threshold amount of time is less than the second threshold amount of time. In some of these embodiments, the first threshold level is greater than the second threshold level. In some of these embodiments, the first threshold level is at least quadruple the second threshold level. In some of these embodiments, the first threshold level is greater than about 600% of a rated load of the circuit interrupter. In some of these embodiments, the second threshold level is less than about 125% of a rated current load of the circuit interrupter. In some of these embodiments, first solenoid and/or the second solenoid is a hammer type solenoid. In some of these embodiments, the circuit interrupter is a circuit breaker.

In another embodiment of the present invention is a circuit interrupter having a first contact, a second contact attached to a pivot point and movable with respect to the first contact, and a spring mechanism biasing the second contact away from the first contact. A trip arm releases the spring mechanism moving the second contact between a closed position in which the second contact is touching the first contact and a current is allowed to flow through the contacts to an open position in which the second contact is spaced apart from the first contact so that the flow of the current is interrupted. A first trip mechanism through which the current flows when the second contact is in the closed position has a first solenoid, a first overcurrent sensor, and a plunger having a first plunger head and a second plunger head. A second trip mechanism through which the current flows when the second contact is in the closed position has a second solenoid, a second overcurrent sensor, and an arm. Upon immediate detection of a first threshold level, the first trip mechanism immediately actuates the first plunger head which actuates the trip arm and immediately actuates said second plunger head which rotates the second contact about the pivot point. The second trip mechanism activates the arm after a threshold amount of time which actuates the trip arm when the second overcurrent sensor detects a second threshold level, the second threshold level being less than the first threshold level.

In some of these embodiments, the first threshold level is at least quadruple the second threshold level. In some of these embodiments, the first threshold level is greater than about 600% of a rated current load of the circuit interrupter. In some of these embodiments, the second threshold level is less than about 125% of a rated current load of the circuit interrupter. In some of these embodiments, the first solenoid is a hammer type solenoid. In some of these embodiments, the circuit interrupter is a circuit breaker.

In another embodiment of the present invention is a circuit interrupter having a first contact and a second contact moveable with respect to the first contact. A trip arm moves the second contact between a closed position in which the second contact is touching the first contact and a current is allowed to flow through the contacts and an open position in which the second contact is spaced apart from the first contact so that the flow of the current interrupted. A first trip mechanism through which the current flows when the second contact is in the closed position activates the trip arm after a first threshold amount of time when a first threshold level is detected. A second trip mechanism through which the current flows when the second contact is in the closed position activates the trip arm after a second threshold amount of time when a second threshold level is detect, the second threshold level being different than the first threshold level.

In some of these embodiments, the first threshold amount of time is less than the second threshold amount of time. In some of these embodiments, the first threshold level is greater than the second threshold level. In some of these embodiments, the first threshold level is at least quadruple the second threshold level. In some of these embodiments, the first threshold level is greater than about 600% of a rated current load of the circuit interrupter. In some of these embodiments, the second threshold level is less than about 125% of a rated current load of the circuit interrupter. In some of these embodiments, the circuit interrupter is a circuit breaker.

In another embodiment of the present invention is a circuit interrupter having a first contact and a second contact. A trip arm moves the second contact between a closed position where the second contact is touching the first contact and current is allowed to flow through the contacts and an open position where the second contact is spaced apart from the first contact so that the flow of the current is interrupted. A first trip mechanism through which the current flows to the first contact has a first solenoid, a first overcurrent sensor, and a first arm. A second trip mechanism through which the current flows when the second contact is in the closed position has a second solenoid, a second overcurrent sensor, and a second arm. The first trip mechanism activates the first arm after a first threshold amount of time which actuates the trip arm when the first overcurrent sensor detects a first threshold level. The second trip mechanism activates the second arm after a second threshold amount of time which actuates the trip arm when the second overcurrent sensor detects a second threshold level, the second threshold level being different than the first threshold level.

In some of these embodiments, the first threshold amount of time is less than the second threshold amount of time. In some of these embodiments, the first threshold level is greater than the second threshold level. In some of these embodiments, the first threshold level is at least quadruple the second threshold level. In some of these embodiments, the first threshold level is greater than about 600% of a rated current load of the circuit interrupter. In some of these embodiments, the second threshold level is less than about 125% of a rated current load of the circuit interrupter. In some of these embodiments, the first solenoid and/or second solenoid is a hammer type solenoid. In some of these embodiments, the circuit interrupter is a circuit breaker.

In another embodiment of the present invention a method for activating a circuit interrupter comprises the steps of detecting a current level, activating a first trip mechanism after a first threshold amount of time if the current level exceeds a first threshold level, and activating a second trip mechanism after a second threshold amount of time if the current level exceeds a second threshold level, the first threshold level being different than the second threshold level.

In some of these embodiments, the first threshold amount of time is less than the second threshold amount of time. In some of these embodiments, the first threshold level is greater than the second threshold level. In some of these embodiments, the first threshold level is at least quadruple the second threshold level. In some of these embodiments, the first threshold level is greater than about 600% of a rated current load of the circuit interrupter. In some of these embodiments, the second threshold level is less than about 125% of a rated current load of the circuit interrupter. In some of these embodiments, the first trip mechanism includes a first overcurrent sensor, a first solenoid, and a plunger. In some of these embodiments, the second trip mechanism includes a second overcurrent sensor, a second solenoid, and an arm.

In another embodiment of the present invention is a circuit interrupter comprising a first trip mechanism configured to trip the circuit interrupter after a first threshold amount of time if a current exceeds a first threshold level and a second trip mechanism configured to trip the circuit interrupter after a second threshold amount of time if the current level exceeds a second threshold level, the first threshold level being different than the second threshold level.

In some embodiments, the first threshold amount of time is less than the second threshold amount of time. In some embodiments, the first threshold level is greater than the second threshold level. In some embodiments, the first threshold level is greater than about 600% of a rated current load of the circuit interrupter. In some embodiments, the second threshold level is less than about 125% of a rated current load of the circuit interrupter.

DETAILED DESCRIPTION OF THE INVENTION

Figure 1:
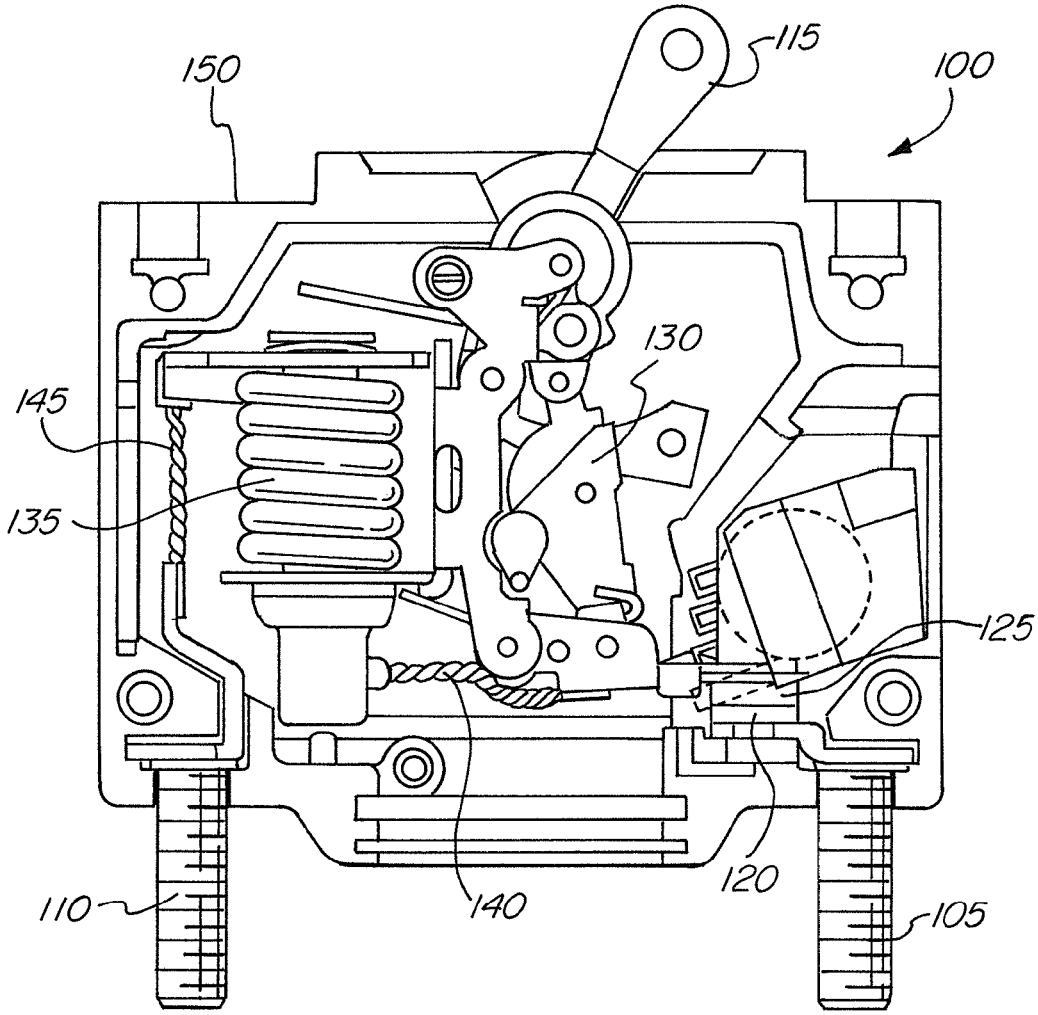
FIG. 1 (PRIOR ART)
FIG. 1 is a side view of a circuit interrupter according to the prior art.

The exemplary embodiments of the present invention may be further understood with reference to the following description and the related appended drawings, wherein like elements are provided with the same reference numerals. The exemplary embodiments of the present invention are related to a device capable of opening a circuit at differing voltage or current levels and based on different durations of the voltage or current levels. Specifically, the device uses a plurality of solenoids to trip and open a circuit in a circuit interrupter. The exemplary embodiments are described with reference to a circuit breaker, but those skilled in the art will understand that the present invention may be implemented on any electrical device that has electrical contacts that can be opened and closed.

As best seen in FIG. 1, a circuit breaker 100 according to the prior art is shown. Circuit breaker 100 is a standard circuit breaker in use today. Circuit breaker 100 has a first terminal 105, which may be connected to the line. Circuit breaker 100 has a second terminal 110, which may be connected to the load. Circuit breaker 100 has a first contact 120. First contact 120 is generally attached to housing 150, and is electrically connected to first terminal 105. Circuit breaker 100 has a second contact 125. Second contact 125 is movable with respect to first contact 120. In a closed position, as shown, second contact 125 is directly touching first contact 120. This allows electricity to flow in through first terminal 105, through first contact 120, into second contact 125, and out through terminal 110.

Second contact 125 is biased away from first contact 120 using a spring mechanism 130. Using a switch 115, spring mechanism 130 is held in place such that second contact 125 is directly touching first contact 120. When circuit breaker 100 is tripped, either manually or through an overload, the spring mechanism is actuated which moves second contact 125 away from first contact 120. This is done by trip mechanism 135.

Trip mechanism 135 is electrically connected to second contact 125 using conductor 140. Trip mechanism 135 is also electrically connected to terminal 110, the line, through conductor 145. When the trip mechanism detects a spike in the current through the circuit breaker, trip mechanism 135 actuates spring mechanism 130, which moves second contact 125 to a position away from first contact 120. The disadvantage of this system is that it is only able to trip the circuit breaker at a single current level. The circuit breaker is not able to provide protection, tripping the circuit breaker, upon the detection of a small current spike for a particular length of time, and also provide for immediately tripping the circuit breaker if a large current spike is detected. This circuit breaker has a delay between the detection of a current spike and the opening of the circuit in the circuit breaker. If a high current spike, or short, occurs, any equipment connected to the circuit breaker can be severely damaged or harmed, or death may come to a person working on equipment attached to the circuit breaker.

Figure 2:
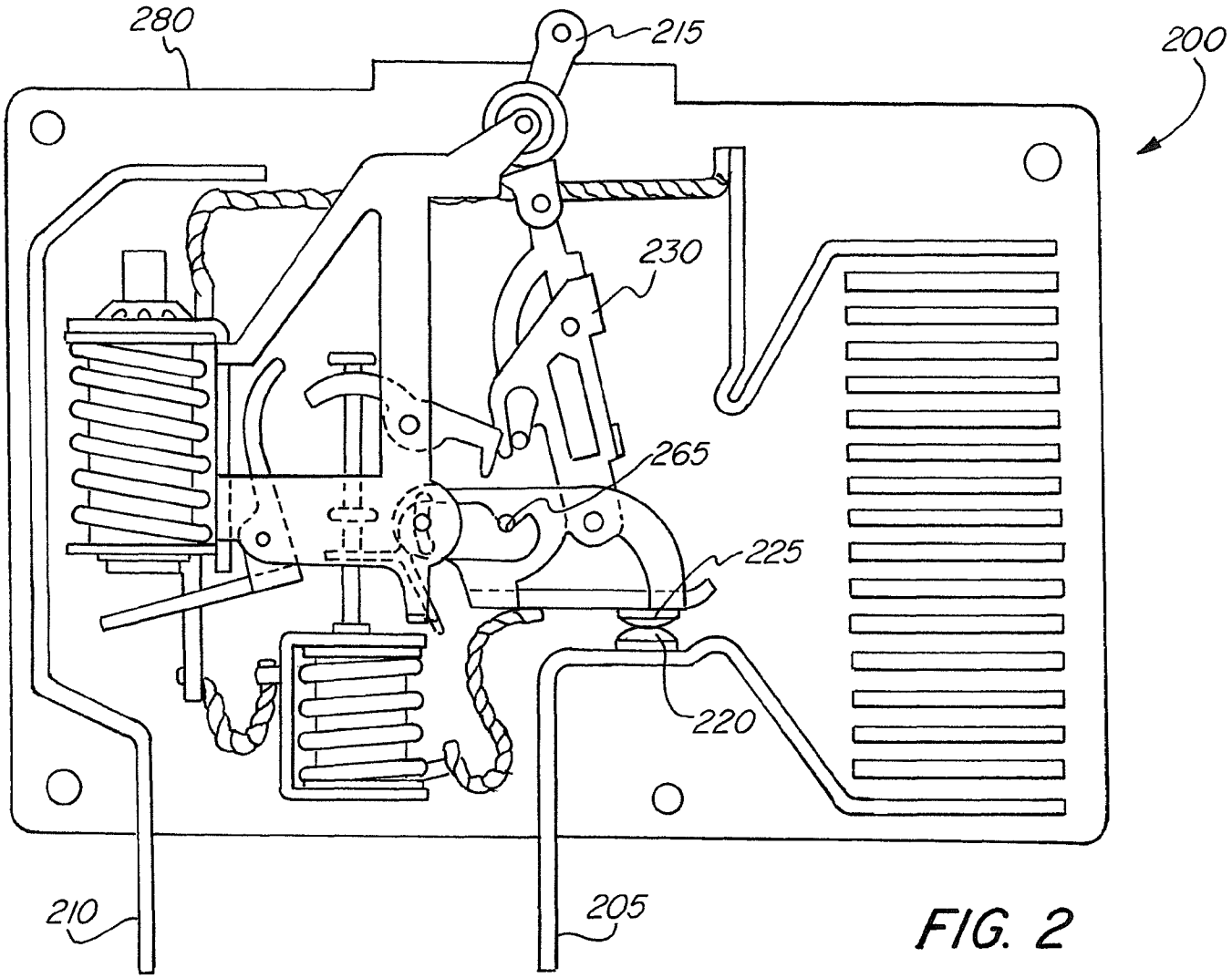
FIG. 2 is a side view of a circuit interrupter in a non-tripped position according to the present invention.

As best seen in FIG. 2, a circuit breaker 200 according to one embodiment of the present invention is shown in the closed position. Circuit breaker 200 can be used in any commercial or non-commercial application, and may be designed to replace current circuit breakers without the need to modify existing equipment. Circuit breaker 200 is designed to trip, or open, the circuit on different conditions, and is thus much more robust than current circuit breakers.

Electricity, generally from a power company, flows into circuit breaker 200 through terminal 205. Terminal 205, which can be referred to as the line, is connected to a first contact 220. First contact 220 remains stationary, and may be attached to housing 280 of circuit breaker 200. A second contact 225 is movable with respect to first contact 220. Generally electrical contact 225 is electrically connected to terminal 210, which is connected to the load, or the equipment drawing power, however, electrical contact 225 may be electrically connected to the line or the load. Electrical contact 225 is movable with respect to electrical contact 220. During normal operation, circuit breaker 200 is in a closed position whereby electrical contact 225 touches electrical contact 220. This allows electricity to flow from the line to the load. If there is an overload or a short in the circuit, circuit breaker 200 automatically trips, causing electrical contact 225 to separate from electrical contact 220.

Electrical contact 225 is held in place by spring mechanism 230. Spring mechanism 230 is biased in a direction away from electrical contact 220 such that electrical contact 225 is also biased away from electrical contact 220. Spring mechanism 230 is connected to switch 215, which is used to manually open or close circuit breaker 200. In the closed position, spring mechanism 230 is pushed in a downward direction, pushing electrical contact 225 to a position touching electrical contact 220. Electrical contact 220 may be supported by a pin 265, which creates a pivot point on which electrical contact 220 can rotate.

Figure 3:
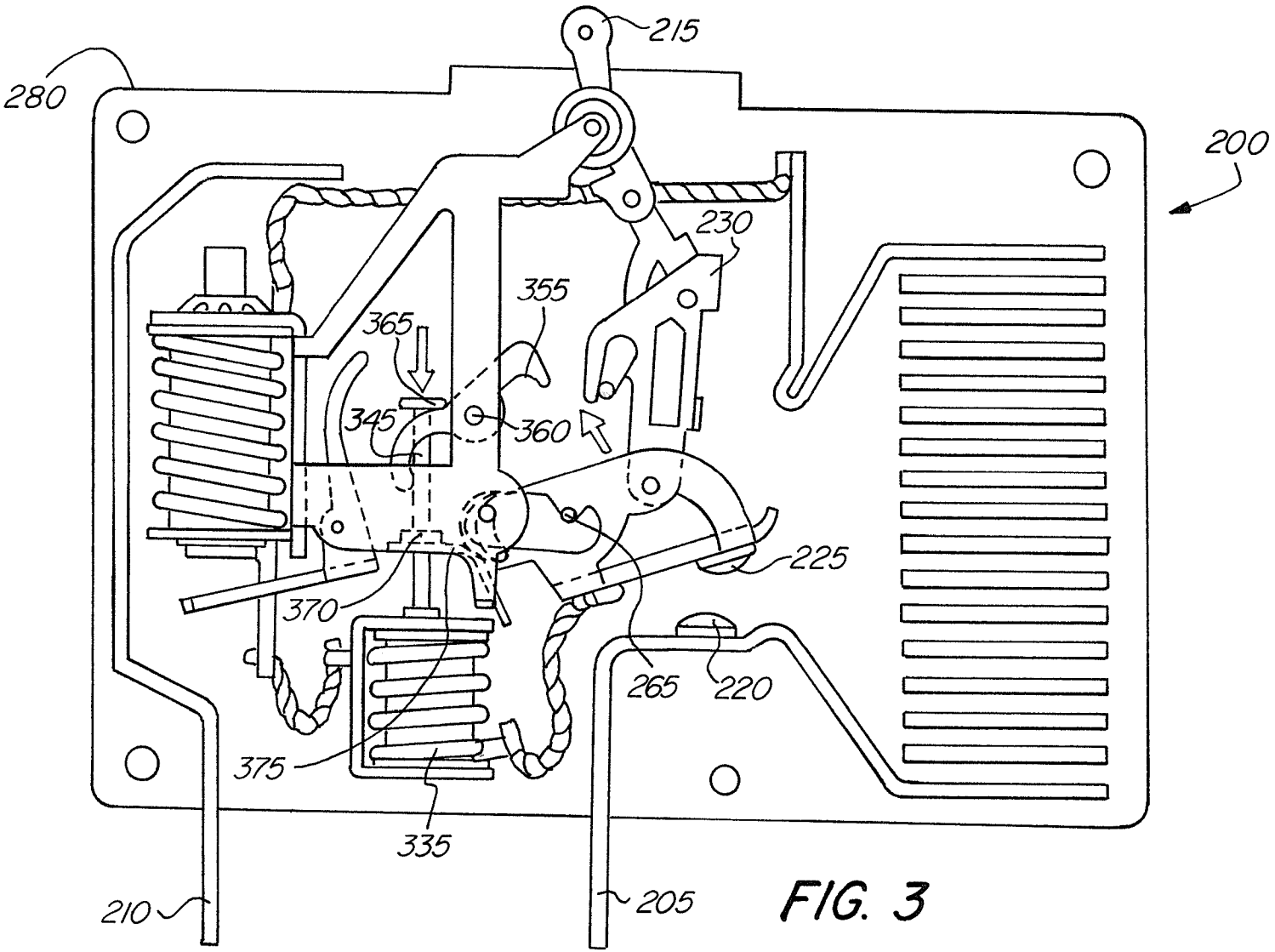
FIG. 3 is a side view of the circuit interrupter from FIG. 2 in a tripped position.

As best seen in FIG. 3, a side view of circuit breaker 200 in the open position is shown. When circuit breaker 200 is in the closed position (FIG. 2), electricity flows through terminal 205, through electrical contact 220, and into electrical contact 225. Electrical contact 225 is electrically connected to a first trip mechanism 335. First trip mechanism 335 may have a solenoid and an overcurrent sensor. When the overcurrent sensor detects a certain current, the overcurrent sensor may activate the solenoid, which actuates plunger 345. Plunger 345 is pulled in a downward direction, which moves a first plunger head 365 in a downward direction. First plunger head 365 moves arm 355 around pivot point 360. The movement of arm 355 causes contact between arm 355 and spring mechanism 230, which releases spring mechanism 230. As spring mechanism 230 biases second electrical contact 225 away from first electrical contact 220, second electrical contact 225 begins to move away from first electrical contact 220. However, spring mechanism 230 may require a relatively long period of time to move second electrical contact 225 away from first electrical contact 220. To facilitate quicker tripping of circuit breaker 200, a second plunger head 370 is also pulled in a downward direction. The downward direction of second plunger head 370 causes contact between second plunger head 370 and a flange 375 extending from second electrical contact 225. The pulling down of flange 375 by second plunger head 370 cause second electrical contact 225 to immediately separate from first electrical contact 220, rotating around pivot point 265.

First trip mechanism 335 may include a hammer type solenoid to allow for immediate tripping of circuit breaker 200, however, first trip mechanism 335 may include any type of known solenoid capable of pulling plunger 345 in a downward direction. A hammer solenoid is preferable as a hammer solenoid is capable of quickly actuating any arm or plunger connected to it to allow for the immediate tripping of circuit breaker 200.

First trip mechanism 335 may be designed to trip circuit breaker 200 upon immediate detection of a certain current level. For example, first trip mechanism 335 may immediately trip circuit breaker 200 upon a detection of a load of about 600% of the maximum rated load of circuit breaker 200. Any spike corresponding to about 600% is generally accepted to be a current level which does not normally occur, and may be indicative of a specific problem. Upon the detection of a current spike of about 600%, it is preferable to trip the circuit breaker as quickly as possible to prevent damage to equipment connected to circuit breaker 200 or to prevent harm to a person working on the load side of the circuit breaker. In a preferred embodiment, the circuit breaker is tripped immediately, or at a shorter period of time than the delay used in tripping the circuit breaker upon the detection of a low current spike.

First trip mechanism 335 may also be designed to trip circuit breaker 200 only after a certain threshold current level has been exceeded for a threshold amount of time. For example, first trip mechanism 335 may trip circuit breaker 200 only if the current level exceeds about 125% of the maximum rated current level of circuit breaker for a certain period of time. A current level of about 125%, with a delay in the tripping for a threshold amount of time, is generally accepted to be a load level which can avoid accidental tripping of the circuit breaker. It should be noted that the above load levels are purely exemplary and first trip mechanism 335 may trip circuit breaker 200 at any load level or after any amount of time as determined by the usage requirements of circuit breaker 200.

Figure 4:
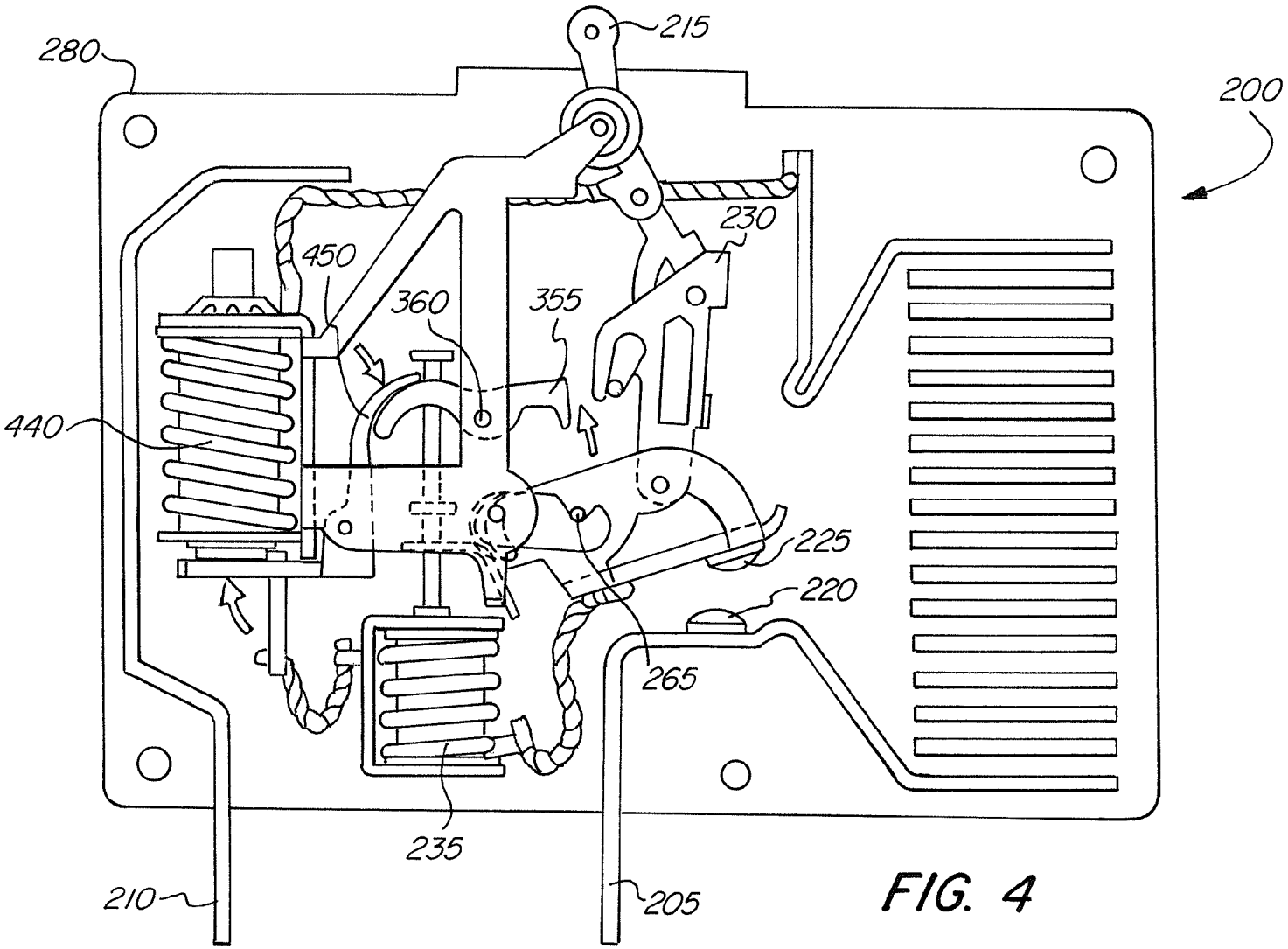
FIG. 4 is a side view of the circuit interrupter from FIG. 2 in a tripped position.

As best seen in FIG. 4, circuit breaker 200 in the open position is shown. First trip mechanism 335 is electrically connected to a second trip mechanism 440. Second trip mechanism 440 also consists of a solenoid and an overcurrent sensor. As stated above, the solenoid may be a hammer type solenoid or any other type of known solenoid. Second trip mechanism 440 is connected to an arm 450. When second trip mechanism 440 is activated, arm 450 is rotated to come into contact with arm 355. The contact between arm 450 and arm 355 causes arm 355 to rotate about pivot point 360 and release spring mechanism 230, which moves electrical contact 225 to a position away from electrical contact 220. As stated above with respect to first trip mechanism 335, second trip mechanism 440 may trip circuit breaker 200 upon immediate detection of a certain load level, or after a threshold amount of time when the level exceeds a certain load level. It should be noted that both first trip mechanism 335 and second trip mechanism 440 may designed to trip at different load levels and/or after the load level exceeds different threshold amounts of time.

Figure 5:
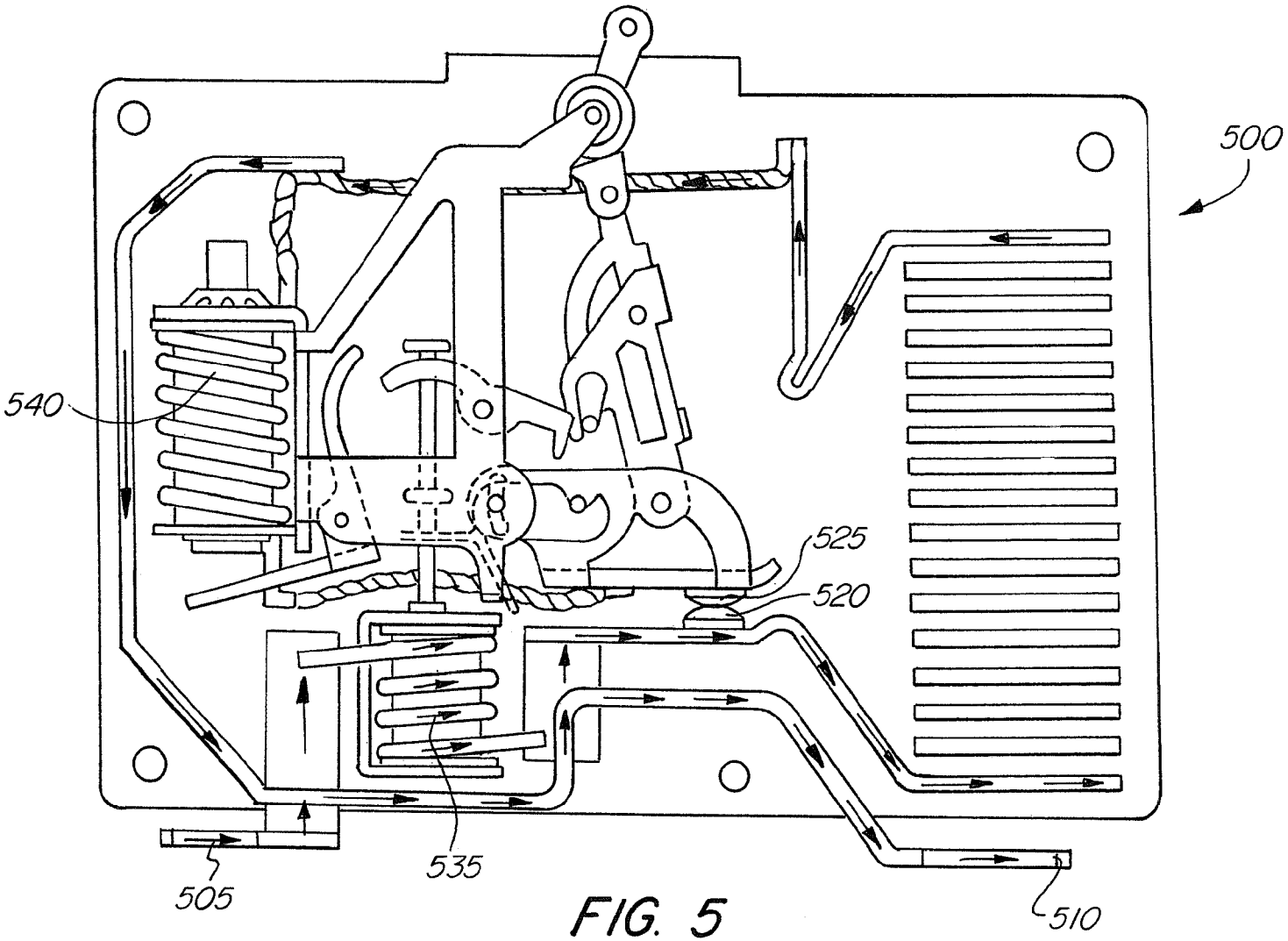
FIG. 5 is a side view of a circuit interrupter according to another embodiment of the present invention.

As best seen in FIG. 5, a circuit breaker 500 in the closed position according to another embodiment of the present invention is shown. Circuit breaker 500 is designed similarly to circuit breaker 200, except that the trip mechanisms have different electrical connections.

Circuit breaker 500 has a first terminal 505, which may be connected to the line. Power comes in through terminal 505, generally from a power company, and flows through first trip mechanism 535. First trip mechanism 535 acts in a similar manner to first trip mechanism 335 and will trip circuit breaker 500 after a threshold amount of time, when the current exceeds a threshold level. In a preferred embodiment, First trip mechanism 535 immediately trips circuit breaker 500 upon the detection of a large current spike. First trip mechanism 535 is electrically connected to a first contact 520, which may be in contact with a second electrical contact 525 when circuit breaker 500 is in the closed position. Circuit breaker 500 has as second trip mechanism 540 which is electrically connected to contact 525. Second trip mechanism 540 acts in a similar manner to second trip mechanism 340 and may trip circuit breaker 500 after a threshold amount of time when the current exceeds a threshold level.

This device has the advantage in that the circuit interrupter can trip on two different conditions allowing the device to be used in a variety of applications not suited for current circuit breakers as the circuit interrupter can trip upon the immediate detection of an extremely high current level, thus preventing harm to a person working on the load of the circuit interrupter, or the circuit interrupter can trip after a certain amount of time has passed, thus preventing any damage to the components connected to the load.

It would be appreciated by those skilled in the art that various changes and modification can be made to the illustrated embodiment without departing from the spirit of the invention. All such modification and changes are intended to be covered hereby.

What is claimed is:

1. A circuit interrupter for interrupting a current said circuit interrupter comprising:

a first contact;

a second contact movable with respect to said first contact;

a trip arm which moves said second contact between a closed position in which said second contact is touching said first contact and the current is allowed to flow through said contacts and an open position in which said second contact is spaced apart from said first contact so and flow of the current is interrupted;

a first trip mechanism through which the current flows when said second contact is in said closed position, said first trip mechanism comprising: a first solenoid, a first overcurrent sensor, and a first arm;

a second trip mechanism through which the current flows when said second contact is in said closed position, said second trip mechanism comprising: a second solenoid, a second overcurrent sensor, and a second arm;

wherein said first trip mechanism activates said first arm after a first threshold amount of time which actuates said trip arm when said first overcurrent sensor detects a first threshold level; and wherein said second trip mechanism activates said second arm after a second threshold amount of time which actuates said trip arm when said second overcurrent sensor detects a second threshold level, said second threshold level being different than said first threshold level;

wherein said first threshold amount of time is different from said second threshold amount of time.

2. The circuit interrupter of claim 1, wherein said first threshold amount of time is less than said second threshold amount of time.

3. The circuit interrupter of claim 1, wherein said first threshold level is greater than said second threshold level.

4. The circuit interrupter of claim 1, wherein said first threshold level is greater than about 600% of a rated current load of said circuit interrupter.

5. The circuit interrupter of claim 1, wherein said second threshold level is less than about 125% of a rated current load of said circuit interrupter.

6. The circuit interrupter of claim 1, wherein one of said first solenoid and said second solenoid is a hammer type solenoid.

7. The circuit interrupter of claim 1, wherein said first arm is a plunger having a first plunger head and a second plunger head, and wherein said first arm immediately actuates said first plunger head which immediately actuates said trip arm and said first arm immediately actuates said second plunger head which rotates said second contact about a pivot point disconnecting said first contact and said second contact.

8. A circuit interrupter for interrupting a current said circuit interrupter comprising:

a first contact;

a second contact attached to a pivot point movable with respect to said first contact;

a spring mechanism biasing said second contact away from said first contact;

a trip arm releases said spring mechanism moving said second contact between a closed position in which said second contact is touching said first contact and the current is allowed to flow through said contacts to an open position in which said second contact is spaced apart from said first contact and the flow of the current is interrupted;

a first trip mechanism through which the current flows when said second contact is in said closed position, said first trip mechanism comprising: a first solenoid, a first overcurrent sensor, and a plunger having a first plunger head and a second plunger head;

a second trip mechanism through which the current flows when said second contact is in said closed position, said second trip mechanism comprising: a second solenoid, a second overcurrent sensor, and an arm;

wherein upon immediate detection of a first threshold level, said first trip mechanism immediately actuates said first plunger head which actuates said trip arm and immediately actuates said second plunger head which rotates said second contact about said pivot point; and wherein said second trip mechanism activates said arm after a threshold amount of time which actuates said trip arm when said second overcurrent sensor detects a second threshold level, said second threshold level being less than said first threshold level;

wherein said first threshold amount of time is different from said second threshold amount of time.

9. The circuit interrupter of claim 8, wherein said first threshold level is greater than about 600% of a rated current load of said circuit interrupter.

10. The circuit interrupter of claim 8, wherein said second threshold level is less than about 125% of a rated current load of said circuit interrupter.

11. The circuit interrupter of claim 8, wherein said first solenoid is a hammer type solenoid.

12. A circuit interrupter for interrupting a current said circuit interrupter comprising:

a first contact;

a second contact movable with respect to said first contact;

a trip arm which moves said second contact between a closed position in which said second contact is touching said first contact and the current is allowed to flow through said contacts and an open position in which said second contact is spaced apart from said first contact and the flow of the current is interrupted;

a first trip mechanism through which the current flows when said second contact is in said closed position, said first trip mechanism activating said trip arm after a first threshold amount of time when a first threshold level is detected;

a second trip mechanism through which the current flows when said second contact is in said closed position, said second trip mechanism activating said trip arm after a second threshold amount of time when a second threshold level is detected, said second threshold level being different than said first threshold level;

wherein said first threshold amount of time is different from said second threshold amount of time.

13. The circuit interrupter of claim 12, wherein said first threshold amount of time is less than said second threshold amount of time.

14. The circuit interrupter of claim 12, wherein said first threshold level is greater than said second threshold level.

15. The circuit interrupter of claim 12, wherein said first threshold level is greater than about 600% of a rated current load of said circuit interrupter.

16. The circuit interrupter of claim 12, wherein said second threshold level is less than about 125% of a rated current load of said circuit interrupter.

17. A circuit interrupter for interrupting a current said circuit interrupter comprising:

a first contact;

a second contact movable with respect to said first contact;

a trip arm which moves said second contact between a closed position in which said second contact is touching said first contact and the current is allowed to flow through said contacts and an open position in which said second contact is spaced apart from said first contact and the flow of the current is interrupted;

a first trip mechanism through which the current flows to said first contact comprising: a first solenoid, a first overcurrent sensor, and a first arm;

a second trip mechanism through which the current flows when said second contact is in the closed position, said second trip mechanism comprising: a second solenoid, a second overcurrent sensor, and a second arm;

wherein said first trip mechanism activates said first arm after a first threshold amount of time which actuates said trip arm when said first overcurrent sensor detects a first threshold level; and wherein said second trip mechanism activates said second arm after a second threshold amount of time which actuates said trip arm when said second overcurrent sensor detects a second threshold level, said second threshold level being different than said first threshold level;

wherein said first threshold amount of time is different from said second threshold amount of time.

18. The circuit interrupter of claim 17, wherein said first threshold amount of time is less than said second threshold amount of time.

19. The circuit interrupter of claim 17, wherein said first threshold level is greater than said second threshold level.

20. The circuit interrupter of claim 17, wherein said first threshold level is greater than about 600% of a rated current load of said circuit interrupter.

21. The circuit interrupter of claim 17, wherein said second threshold level is less than about 125% of a rated current load of said circuit interrupter.

22. The circuit interrupter of claim 17, wherein one of said first solenoid and said second solenoid is a hammer type solenoid.

23. A method of activating a circuit interrupter comprising the steps of:

detecting a current level;

activating a first trip mechanism after a first threshold amount of time if the current level exceeds a first threshold level;

activating a second trip mechanism after a second threshold amount of time if the current level exceeds a second threshold level;

wherein the first threshold level is different than the second threshold level; and, wherein said first threshold amount of time is different from said second threshold amount of time.

24. The method of claim 23, wherein the first threshold amount of time is less than the second threshold amount of time.

25. The method of claim 23, wherein the first threshold level is greater than the second threshold level.

26. The method of claim 23, wherein the first threshold level is greater than about 600% of a rated current load of the circuit interrupter.

27. The method of claim 23, wherein the second threshold level is less than about 125% of a rated current load of the circuit interrupter.

28. A circuit interrupter comprising:

a first trip mechanism configured to trip said circuit interrupter after a first threshold amount of time if a current exceeds a first threshold level;

a second trip mechanism configured to trip said circuit interrupter after a second threshold amount of time if the current level exceeds a second threshold level;

wherein the first threshold level is different than the second threshold level;

wherein said first threshold amount of time is different from said second threshold amount of time.

29. The circuit interrupter of claim 28, wherein said first threshold amount of time is less than said second threshold amount of time.

30. The circuit interrupter of claim 28, wherein said first threshold level is greater than said second threshold level.

31. The circuit interrupter of claim 28, wherein said first threshold level is greater than about 600% of a rated current load of said circuit interrupter.

32. The circuit interrupter of claim 28, wherein said second threshold level is less than about 125% of a rated current load of said circuit interrupter.

* * * * *